United States Patent [19]

Deschamps et al.

[11] Patent Number: 4,770,553

[45] Date of Patent: Sep. 13, 1988

[54] PRINTING RIBBON CARTRIDGE FOR A PRINTING MACHINE, PARTICULARLY FOR HEAT TRANSFER PRINTING

[75] Inventors: Jean-Pierre Deschamps, Grand Quevilly; Benoit Bizet, Cergy, both of France

[73] Assignee: Societe d'Applications Generales d'Electricite et de Mecanique Sagem, France

[21] Appl. No.: 903,719

[22] Filed: Sep. 5, 1986

[30] Foreign Application Priority Data

Sep. 5, 1985 [FR] France ..... 85 13205

[51] Int. Cl.[4] ..... B41J 32/00

[52] U.S. Cl. ..... 400/208; 400/234; 400/196

[58] Field of Search ..... 400/191, 196, 194, 205.1, 400/206.2, 207, 208, 208.1, 246, 247, 248.1, 234

[56] References Cited

U.S. PATENT DOCUMENTS

| | | | |
|---|---|---|---|
| 2,154,058 | 4/1939 | Yollans | 400/205.1 X |
| 4,469,457 | 9/1984 | Chida et al. | 400/208 |
| 4,480,936 | 11/1984 | Kasun et al. | 400/207 |
| 4,497,008 | 1/1985 | Schoenmakers | 400/208 X |
| 4,623,274 | 11/1986 | Ohsaki | 400/208 |
| 4,630,948 | 12/1986 | Karns | 400/208 X |

FOREIGN PATENT DOCUMENTS

| | | | |
|---|---|---|---|
| 141412 | 5/1985 | European Pat. Off. | 400/207 |
| 142687 | 11/1980 | Japan | 400/194 |

*Primary Examiner*—Charles A. Pearson
*Assistant Examiner*—James R. McDaniel
*Attorney, Agent, or Firm*—Larson and Taylor

[57] ABSTRACT

The cartridge comprises two arms situated on both sides of the cartridge body; each arm can occupy either a first, non-functional position (or storage position of the cartridge) or a second, functional position (or use position of the cartridge). Elastic tension means are provided to act on the ribbon to hold the latter taut whatever the functional or non-functional position occupied by the arms.

6 Claims, 2 Drawing Sheets

FIG.1.
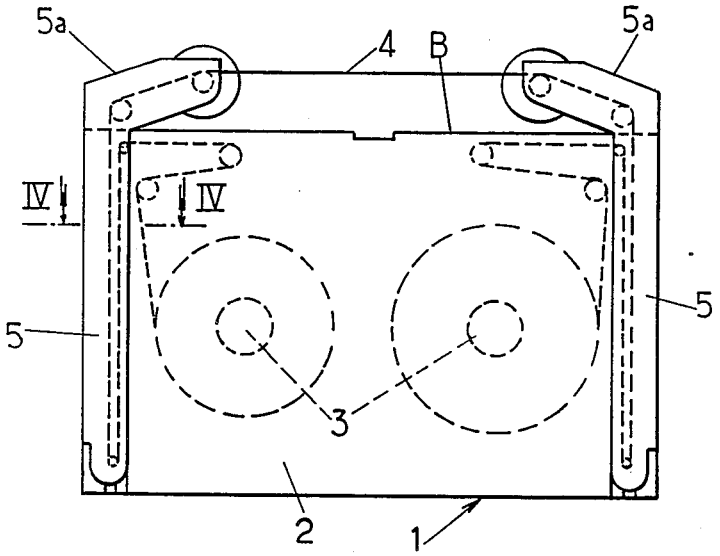
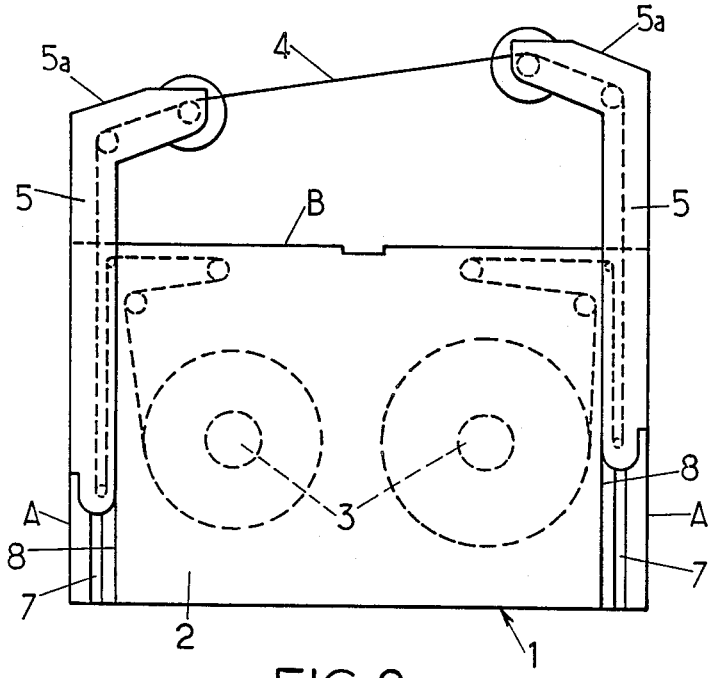
FIG.2.

PRINTING RIBBON CARTRIDGE FOR A PRINTING MACHINE, PARTICULARLY FOR HEAT TRANSFER PRINTING

BACKGROUND OF THE INVENTION

The present invention relates to a printing ribbon cartridge arrangement for a printing machine, particularly for printing by heat transfer, comprising a cartridge body possessing: an entrance and an exit for ribbon situated on or in the immediate vicinity of a first side of the cartridge body ; two spindles for winding the ribbon thereon and unwinding the ribbon therefrom ; and guide means for guiding the ribbon in movement.

In certain types of printing machines, and in particular in certain rapid printing machines, such as, for example, (but not exclusively) in certain heat transfer printing machines, it is desirable to lighten the movable carriage to the maximum, comprising among others things the printing means, so as to reduce the inertia thereof and to increase its speed of movement whilst preserving all the accuracy required in its positioning with respect to the printing. In this quest for weight reduction, it has appeared desirable that the printing ribbon cartridge, which is traditionally mounted on the carriage, should be separated from the latter: it is then necessary for this cartridge either to be mounted fixed to the machine, the carriage, and in particular the printing means, then moving past, for the printing of each line, not only in front of the printing support, but also in front of the ribbon.

Such an arrangement therefore involves, on each printing sequence, a presentation in front of the printing support of a length of ribbon at least equal to the maximum length of the line to be printed, that is to say at least equal to the width of the printing support.

It is possible to envisage the construction of one-piece cartridges. However, such cartridges would be too bulky and, consequently, difficult and expensive to store, difficult to handle and, generally, of too high a cost price.

GENERAL DESCRIPTION OF THE INVENTION

It is essentially an object of the invention to provide a printing ribbon cartridge which possesses dimensions of the same order of magnitude as conventional cartridges in their storage and arranged to disengage in their use, a sufficient length of ribbon to cover one line of print, whilst being of simple construction and hence relatively inexpensive, and whilst being arranged to contain, if necessary, very thin ribbon (for example of thickness less than 12 $\mu$m ) used for heat transfer printing.

Accordingly, a cartridge of the aforementioned type, arranged according to the invention, is characterized in that it comprises in addition two arms situated on both sides of the cartridge body and supported respectively on the two opposite sides substantially transversal to the abovesaid first side, each arm having a first end provided with means for sliding and pivoting connection with the corresponding side of the cartridge body so that the arm can move from a first, non-functional position (or storage position of the cartridge) in which the arm extends along the side of the cartridge body with said first end situated in the vicinity of the side of the cartridge opposite the abovesaid first side and with its free end—provided with guide means over which the ribbon passes—situated in the vicinity of the abovesaid first side, to pass, by axial sliding followed by a rotation, to a second, functional position (or position of use of the cartridge) in which the arm extends substantially in the prolongation of the abovesaid first side with its first end situated in the vicinity of said first side, and in that it comprises in addition elastic tension means acting on the ribbon to maintain the latter taut whatever the position (folded or extended) of the arms as well as in the course of the passage of the arms from one of their positions to the other.

Thus, it is possible, according to the invention, to produce a cartridge which, with its arms folded, possesses general dimensions substantially identical with those of a standard cartridge receivable on the movable printing system, but which, with its arms deployed, extends substantially over at least the whole width of the printing support and exposes a length of ribbon at least equal to the width of this printing support.

Advantageously, in such a cartridge the connecting means provided at the first end of each arm comprise at least one guide pin adapted to slide in a gutter provided along the corresponding side of the cartridge body, locking means preventing the rotation of the arm whilst the pin is not situtated at the end of said gutter close to the first side of the cartridge body: in this way there is produced a cartridge structure which is particularly simple to manufacture, to mount and to use, with a small number of constituent parts.

It may be also advantageous for each arm to possess a U-shaped or tubular cross-section to shield and protect the portion of ribbon which traverses it.

In an advantageous embodiment particularly for very thin ribbons (such as those intended for heat printing machines) which do not possess sufficient transverse stiffness to be guidable by thrusting against a guide plate, the guide means of the ribbon comprise loose barrel-shaped upset rollers which ensure automatic return of the ribbon into its correct alignment position.

Finally, to avoid any operational accident due to lack of synchronism of the respective rotations of the payout and take-up spools of the ribbon, there is provided, in addition, synchronizing means for the peripheral speed of the ribbon on the winding spindle and on the unwinding spindle, in order to avoid any tension or floating of the ribbon in the course of movement ; advantageously such synchronizing means comprise an idling wheel supported at one end of an arm recalled elastically so that the idling wheel is held constantly supported elastically simultaneously on the two ribbon spools of the winding and unwinding spindles.

The invention will be better understood on reading the detailed description which follows of a preferred embodiment, given purely by way of illustrative example without being of any limiting character; in this description reference is made to the accompanying drawings.

BRIEF DESCRIPTION OF THE DRAWINGS

In the drawings:

FIGS. 1 and 2 are diagrammatic side views of a printing ribbon cartridge, arranged according to the invention, shown respectively in a storage position and in an intermediate position;

DESCRIPTION OF A PREFERRED EMBODIMENT

The ribbon cartridge according to the invention, shown in FIGS. 1 and 2, comprises a housing 1, in flattened parallelepipedic form whose general dimensions correspond substantially to those of a customary cartridge designed to be received on the movable carriage of the printing machine. The two principal faces 2 of this housing support the two spindles 3 of the spools on which the ribbon 4 is wound.

Figure 4:
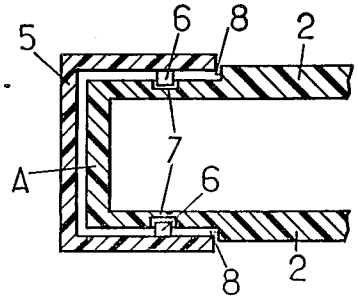

Two opposite sides A of the housing 1 are equipped respectively with two arms 5 movable in translation parallel with the sides A of the housing and in rotation. Each arm 5 is constituted by a part of U-shaped profile straddling the corresponding side A of the housing 1, as seen more clearly in FIG. 4. The two facing branches of the U bear respectively two projecting pins 6, directed to towards one another, engaged in two respect gutters 7 channeled in the principal surfaces 2 of the housing parallel with the side A of the latter. In addition, the principal surfaces 2, in the vicinity of their extreme edges neighboring the sides A concerned, have a recessed portion defining shoulders 8 parallel with gutters 7 and against which the longitudinal edges of the branches of the U shaped arms can find support.

Thus, in the position shown in FIGS. 1 and 2, the arms 5 can only slide parallel with the sides A of the housing 1, without being able to effect rotation. Once the arms 5 have come into maximum extension (stops—not visible—provided at the end of the gutters 7 prevent the pins 6 from leaving the latter), these arms are free to pivot by 90° outwardly, separating from the housing 1, to extend approximately in prolongation of one of the large sides B of the housing 1, as shown in FIG. 3.

Figure 3:
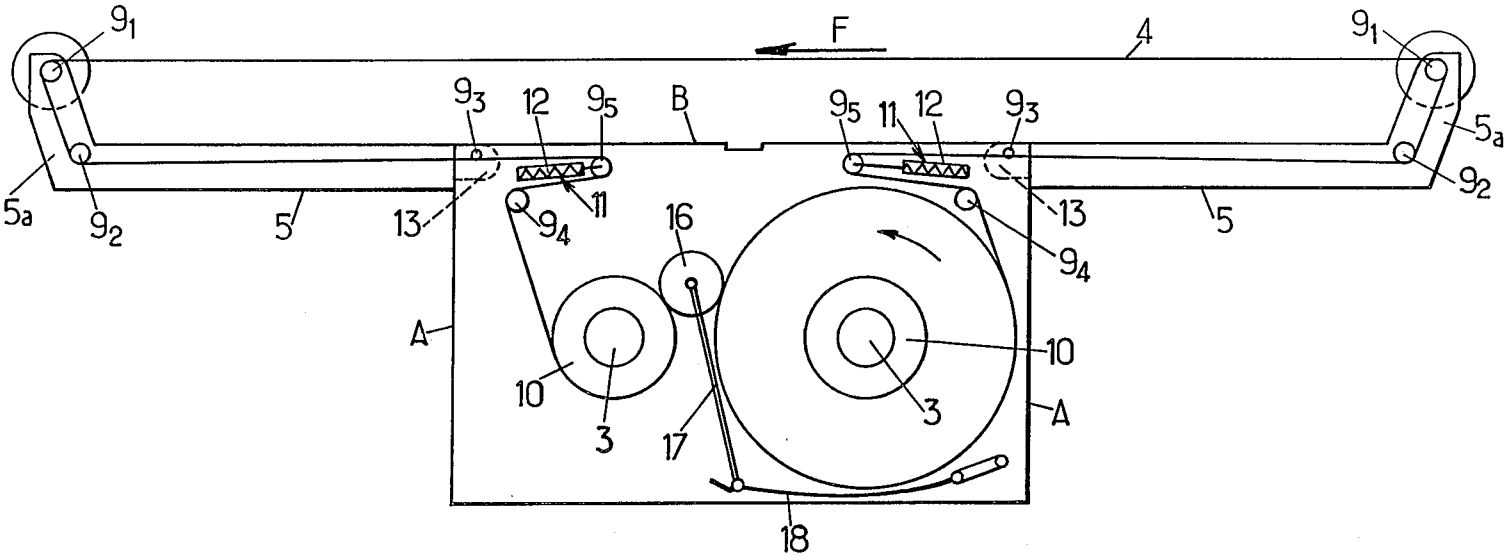
FIG. 3 is a diagrammatic side view showing the cassette of FIG. 1 in functional position, a principal face of the cartridge being removed to show the internal arrangement thereof.

The ends 5*a* of the arms 5 are inclined so that, in the functional printing position shown in FIG. 3, the exposed portion of the ribbon 4 is spaced away from the edge of the housing 1.

Return rollers 9 are provided at suitable places: rollers $9_1$ at the free ends of the arms 5; rollers $9_2$ at the angles of the arms 5; rollers $9_3$ at the ends of the arms 5 bearing the above mentioned pins 6; rollers $9_4$ in the vicinity of the spools 10 on which the ribbon is wound.

In addition means 11 for maintaining the ribbon under tension comprise rollers $9_5$ mounted on springs 12; the rollers $9_5$ are thus free to oscillate between two extreme positions as a function of the force exerted by the ribbon and hold the latter with a substantially constant tension. Taking into account the direction of the passage of the ribbon shown (arbitrarily) by the arrow F in FIG. 3, the left-hand spool 10 is receiving (drive) and the left-hand roller $9_5$ is completely thrust down into end of travel abutment, whilst the right-hand spool 10 being in unwinding condition, the lefthand roller 9 oscillates around an equilibrium position which ensures the constancy of the tension of the ribbon.

Of course, openings 13 are provided, for the passage of the ribbon 4, in the sides A of the housing 1, in the neighborhood of their junction with the side B.

In FIGS. 1 and 2, the ribbon 4 has been shown in full-line for its visible portion and in dashed lines for its hidden portion.

Taking into account the U-shaped structure of the arms 5, the ribbon 4 is conducted permanently with shielding from external disturbances and is only accessible between the rollers $9_1$ of the free ends of the arms 5. The length of the arms 5—and hence the length of the sides A of the cartridge—is determined so that the length of the accessible portion of the ribbon 4 (slightly less than the distance between the rollers $9_1$) is at least equal to the maximum length of a print line on the print support ( that is to say substantially the width of a sheet of paper, for example).

Figure 5:
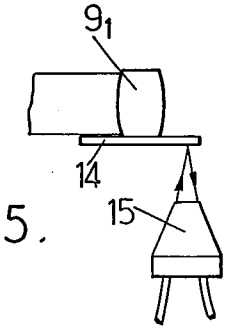
FIGS. 4 and 5 are diagrammatic views from above showing respectively two details of the construction of the cartridge of FIGS. 1 to 3.

In particular, in the case of ribbons used for heat transfer printing, the thickness of these ribbons is very small (for example less than 12 $\mu$m). Such ribbons hence do not possess the transverse strength necessary to be able to be conveniently guided by traditional grooved rollers. To overcome this drawback, it is hence provided for various rollers 9, or at least the rollers $9_1$ of the ends of the arms, to be barrel-shaped as shown in FIG. 5: such rollers ensure automatic recentering of the ribbon.

In addition, on one roller axle at least, for example, on the axle of a roller $9_1$, is mounted a disc 14 provided with location means for a detector member 15, connected to a signal processing circuit (not shown) enabling the rotation of the disc 14 to be detected and hence the passage of the ribbon to be controlled, on the positioning of a new section of virgin ribbon between the printing processes of two successive lines. In simple fashion, the disc 14 can comprise a reference mark and the detector member 14 can be a transmitter-receiver electron-optical device associated with a pulse counting circuit.

To avoid the spools 10 rotating with different peripheral linear speeds—which can result in over-tension of the ribbon with the risk of breakage of the latter or on the other hand inopportune unwinding of the ribbon with the risk of stuffing—there are provided synchronizing means for the rotation of the two spools 10. These means comprise an idling wheel 16 mounted at the free end of a free arm 17 whose other end is mounted free in rotation on elastic return means. The latter may advantageously be constituted by a spring blade 18 of which one end is anchored in the housing 1 and of which the other end supports the arm 17 in rotation, the spring 18 ensuring permanent thrust of the wheel 16 simultaneously against the two ribbon winding of the two spools 10 respectively.

The ribbon cartridge which has just been described is arranged symmetrically. It is thus possible for it to assume symmetrical operation with passage of the ribbon from left to right or from right to left, the two spools being respectively made driving spools selectively. The construction of the cartridge permits in particular the turning over of the latter and the use of two distinct longitudinal areas of the ribbon, which permits the capacity of utilization of the ribbon to be doubled.

As is self-evident and as emerges already besides from the foregoing, the invention is in no way limited to those of its types of application and embodiments which have been more specially envisaged; it encompasses thereof, on the contrary, all modifications.

I claim:

1. Printing ribbon cartridge for a printing machine, comprising a cartridge body possessing: an entrance and an exit for ribbon situated on or in the immediate vicinity of a first side (B) of the cartridge body; two spindles for the winding up and unwinding of the ribbon; and guide means for guiding the ribbon in movement, wherein said cartridge comprises two arms situated on and supported by a second and a third side of the cartridge body, respectively, said second and third sides extending substantially transverse to said first side (B), each arm having a first end provided with means for sliding and pivoting connection with its corresponding second or third side (A) of the cartridge body so that the arm can move from a first, non-functional storage position in which a fourth arm extends along the side of the cartridge body with said first end situated the abovesaid first side (B) and with its free end situated in the vicinity of the abovesaid first side, to pass, by axial sliding followed by rotation, to a second, functional use position in which the arm extends substantially in prolongation of the abovesaid first side (B) with its first end situated in the vicinity of said first side, said guide means being located at the free ends of said arms, and wherein said cassette comprises in addition elastic tension means acting on the ribbon to hold the latter taut whatever the position, folded or extended, of the arms as well as in the course of the passage of the arms from one of their positions to the other, by means of which it is possible to produce a cartridge which , with its arm folded down, possesses general dimensions substantially identical with those of a standard cartridge receivable on the movable printing system, but which, with its arms depolyed, extends substantially over at least a whole width of the print support and exposes a ribbon length at least equal to the width of this print support.

2. Cartridge according to claim 1, wherein the connecting means provided at the first end of each arm comprise at least one guide pin adapted to slide in a gutter provided along the corresponding second or third side (A) of the cartridge body, locking means preventing the rotation of the arm as long as the pin is not situated at the end of said gutter close to the first side (B) of the cartridge body.

3. Cartridge according to claim 1, wherein each arm possesses a U-shaped cross-section to shield and protect the ribbon portion which passes through it.

4. Cartridge according to claim 1, wherein the guide means for the ribbon comprise bulged idling rollers of barrel-shape.

5. Cartridge according to claim 1, comprising, in addition, synchronizing means for the peripheral linear speed of the ribbon over the winding spindle and over the unwinding spindle, in order to avoid any tension and any floating of the ribbon in the course of movement.

6. Cartridge according to claim 5, wherein the synchronizing means comprise an idling wheel supported at one end of an arm recalled elastically so that the idling wheel is held constantly in elastic support simultaneously on the two ribbon spools of the winding and unwinding spindles.

* * * * *